US006824450B2

(12) United States Patent
Opel

(10) Patent No.: US 6,824,450 B2
(45) Date of Patent: Nov. 30, 2004

(54) APPARATUS TO PROVIDE DRY ICE IN DIFFERENT PARTICLE SIZES TO AN AIRSTREAM FOR CLEANING OF SURFACES

(75) Inventor: Alan E. Opel, Monrovia, CA (US)

(73) Assignee: Cold Jet Alpheus LLC, Loveland, OH (US)

( * ) Notice: Subject to any disclaimer, the term of this patent is extended or adjusted under 35 U.S.C. 154(b) by 0 days.

(21) Appl. No.: 10/732,728

(22) Filed: Dec. 10, 2003

(65) Prior Publication Data

US 2004/0121711 A1 Jun. 24, 2004

Related U.S. Application Data

(63) Continuation of application No. 09/966,523, filed on Sep. 28, 2001, now abandoned.

(51) Int. Cl.[7] ..... B24B 1/00

(52) U.S. Cl. ..... 451/53; 451/75; 451/60; 451/99

(58) Field of Search ..... 451/7, 40, 53, 451/60, 99, 75; 62/320, 321, 602, 603, 604, 605

(56) References Cited

U.S. PATENT DOCUMENTS

| | | | | | |
|---|---|---|---|---|---|
| 4,707,951 | A | * | 11/1987 | Gibot et al. | 451/99 |
| 5,135,553 | A | * | 8/1992 | Rebhan | 62/605 |
| 5,367,838 | A | * | 11/1994 | Visaisouk et al. | 451/39 |
| 5,472,369 | A | * | 12/1995 | Foster et al. | 451/39 |
| 6,174,225 | B1 | * | 1/2001 | Becker | 451/75 |

FOREIGN PATENT DOCUMENTS

WO wo 99/22909 * 5/1999

* cited by examiner

*Primary Examiner*—M Rachuba
(74) *Attorney, Agent, or Firm*—Frost Brown Todd LLC

(57) ABSTRACT

Apparatus and method for producing and metering dry ice pellets and particles selectively from the same apparatus with out modification, by appropriate reversal of a production wheel and accompanying selection of dry ice in the form of block or of pellets for a supply to the production wheel.

7 Claims, 4 Drawing Sheets

APPARATUS TO PROVIDE DRY ICE IN DIFFERENT PARTICLE SIZES TO AN AIRSTREAM FOR CLEANING OF SURFACES

This is a continuation of U.S. patent application Ser. No. 09/966,523, filed Sep. 28, 2001 now abandoned, the disclosure of which is incorporated herein by reference.

FIELD OF THE INVENTION

Cleansing of surfaces by the blast of an airstream carrying particles of dry ice. Apparatus providing a selectible capability of either metering preformed dry ice particles while substantially maintaining the size and distribution integrity of said particles or the capability to granulate a block of solid preformed dry ice without modifying the apparatus itself.

BACKGROUND OF THE INVENTION

The use of dry ice (solid $CO_2$) particles in a pressurized airstream to clean surfaces is known art. In this process, the dry ice particles are conveyed through a hose to a nozzle from which the air and the entrained particles are discharged onto the surface that is to be cleaned. The fact that dry ice sublimes directly to a gas makes these particles particularly suited for blasting onto many types of surfaces with the advantage that they leave no residue and are less likely to modify critical surface characteristics.

While in the solid condition, particles of dry ice have useful structural properties for blast cleaning applications. They are able to dislodge and sweep away surface contaminants such as paint on heavy solid surfaces, and preservative coatings on structures as fragile as small electrical coils. Obviously a particle large enough and structurally integral enough to remove a baked-on enamel from a heavy metal structure cannot be used to cleanse the surface of a delicate wire coil. It would destroy the coil. Yet the same material—dry ice—can be used successfully for both purposes.

The difference resides in the size and structure of the particles. For heavy blasting, where it is advantageous that each individual particle impact generates significantly higher kinetic energy, it is common to use preformed dry ice particles in pellet form of a predetermined size and distribution. Such pellets are separately prepared by equipment specifically designed to produce them from a bulk supply of liquid carbon dioxide. They are placed as pellets in a storage bin or hopper in the dry ice blasting apparatus and are metered from it into the airstream and conveyed to an accelerator either through eduction or through a pressurized airstream requiring the use of an airlock. An example is found in U.S. Pat. No. 4,038,789.

However, this same equipment cannot dispense the smaller granular particles that are preferred in many applications. These dry ice granules cannot optimally be stored for subsequent metering because their highly hygroscopic nature coupled with a high surface to mass ratio that produces a strong tendency to clump when stored for even very short time period. In addition, even when very small quantities of dry ice granules are stored, the weight of the granules in the upper portion is sufficient to combine and compress the particles below them into undesirable larger sizes of dry ice.

This challenge was resolved by equipment as presented in U.S. Pat. No. 5,520,572. Such particles are customarily extracted by scraping or shaving preformed dry ice (usually in block form but it could also be in nugget or pellet form) and then immediately feeding the dry ice granules into the airstream at a selectable rate with substantially no storage. However, the conventional granulated dry ice blasting apparatus which existed prior to this invention, when used to create and then inject such particles into an airstream, could not also instead satisfactorily meter the larger preformed dry ice pellets. If this was attempted without significantly modifying the granulator mechanism it would result in damaging pellet integrity and thus changing the cleaning characteristics of the dry ice particles.

To convert a machine from one mode to the other, prior to this invention, required a complete shutdown of the machine, the removal of one major part of the apparatus (a production wheel), and the installation of another. This is time consuming, and prevents the use of the same tool when different areas of a work piece require different types of particles.

Alternatively, another mechanism such as a grinder has been added after the metering device to grind preformed dry ice pellets in a secondary process step added between metering and conveyance. This method adds to the cost and complexity of the apparatus and often creates plugging and feed backup due to improper management of the near constant need to frequently adjust the grinder for variances in pellet sizes, pellet hardness, desired flow rates and humidity levels. This method also requires pellets to granulate and cannot granulate dry ice in block form.

Until now, most users of dry ice blasting equipment have opted for the more expensive alternative or purchasing two separate machines: one type of apparatus for pellet blasting; and another type of apparatus for granule blasting. It is an object of this invention to provide one apparatus with means in one mechanism to both meter (or otherwise produce) and dispense either preformed dry ice pellets or dry ice granules by the mer reversal of direction of a movable carrier (sometimes called a "production wheel"). The savings of time and expense are obvious. Only one set of tooling is required, and no part of it needs to be exchanged when particles of different size or nature are desired.

Another advantage of this invention is its adjustability to provide mixtures of different mass sizes of particles.

BRIEF DESCRIPTION OF THE INVENTION

Apparatus according to this invention is incorporated in a system which includes a supply of pressurized air, a nozzle, a means to convey and inject dry ice particles into a pressurized airstream which passes through a means of acceleration such as a venturi nozzle, and a storage bin to hold dry ice in the form of pellets or block to be metered into the airstream.

A carrier is movably supported and contains two different sets of always-open passages. The carrier is adapted selectively to be driven in a first direction to implement the action of the first set of passages or in a second, different substantially direction to implement the action of the second set of passages. The first set of passages permits passage and metering of dry ice pellets only when the carrier is moved in the first direction. The second set of passages incorporates working edges defining a cutting or scraping surface during movement of the carrier in the second direction and thus simultaneously extracts and meters dry ice granules into the conveyance airstream.

Therefore in one direction of movement or the other, a supply of preformed dry ice pellets of a selected size will be provided to the airlock. To switch from one type of operation to the other, it is necessary only to reverse the direction of direction of the carrier and to provide in the storage bin the appropriate type of dry ice for the type of dry ice particle desired (pellets or granules).

In addition, when pellets are used as a supply, it is possible to adjust the proportion of larger particles and smaller ones to select ratios of particles of various mass (and therefore momentum) and provide a mix of particles.

The above and other features of this invention will be fully understood from the following detailed description and the accompanying drawings, in which:

DETAILED DESCRIPTION OF THE INVENTION

Figure 1:
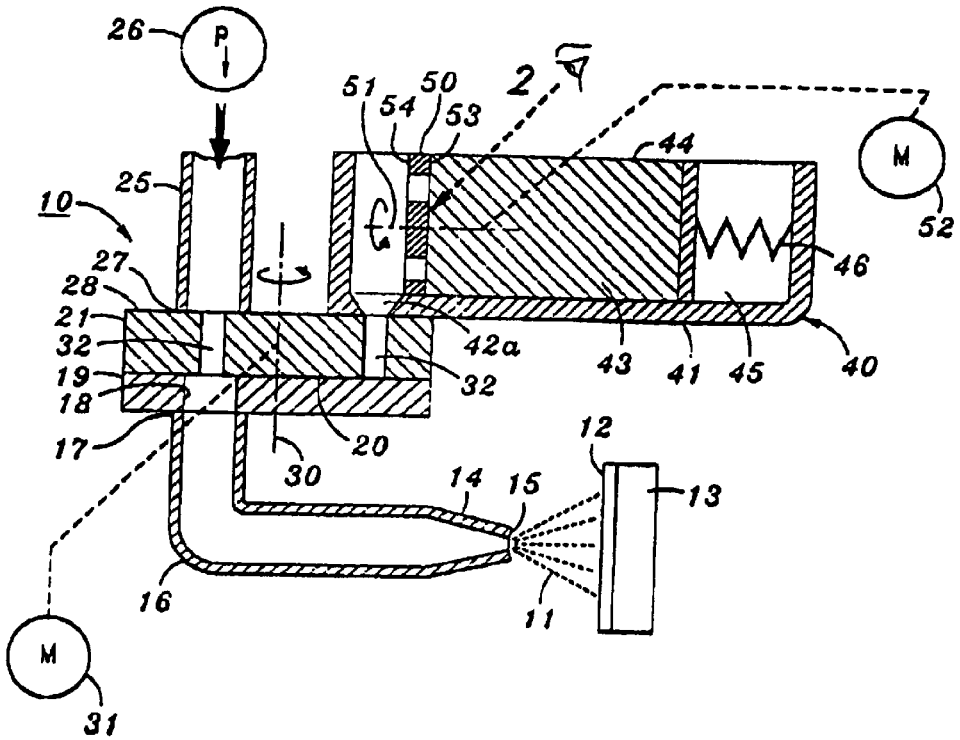
FIG. 1 is a partly-schematic axial section of a system which incorporates the invention.
Figure 2:
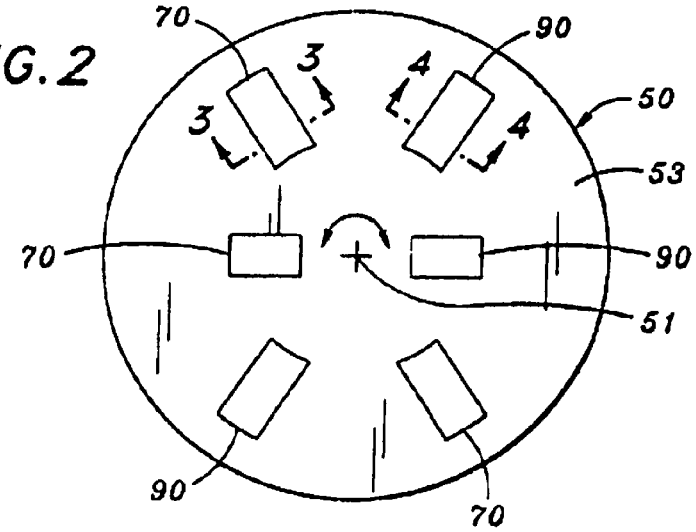
FIG. 2 is a cross-section taken at line 2—2 in FIG. 1, showing the upstream face of a production wheel according to this invention.

FIG. 1 shows the pertinent parts of an example of a dry-ice blasting system 10. This example is for a pressurized air conveyance means using an airlock, but the same principles are applicable to eductor conveyance systems and are readily understood by persons skilled in the art. Its objective is to direct a blasting stream 11 consisting of air and dry ice particles of desired size against a layer 12 of material to be removed from the surface of a work piece 13. The stream exits from a nozzle 14 at the delivery end 15 of a hose 16.

The inlet end 17 of the hose is connected to the outlet port 18 of an outlet plate 19. Plate 19 is stationary. It does not rotate. It acts to cover and seal with the bottom surface 20 of airlock rotor 21, except at its single outlet port 18.

An air hose 25 receives compressed air from a pump 26 or other pressure source. Its outlet end 27 seals with the upper surface 28 of the airlock rotor 21.

Airlock rotor 21 is rotatably mounted for rotation around a central axis 30. It is driven by a motor 31. It includes a ring of transfer chambers 32, arranged in a circle around the central axis. As the airlock rotor rotates, the transfer chambers sequentially arrive at the outlet end 27 of air hose 25, and simultaneously align with the outlet port 18 of the outlet plat 19. During this alignment, air passes from the air hose 25 to the hose 16, together with a supply of dry ice particles, as will be discussed. Air hose 25 is appropriately dimensioned adjacent to the airlock so there is no leakage past it while the hose is even partially aligned with an airlock port.

A storage bin 40 includes a frame 42 which forms a receptacle 43 to receive dry ice 44 and a chute 42*a*. As illustrated, there is a block of dry ice in the receptacle. Alternatively, it can be a collection of dry ice in the receptacle pellets or nuggets. In both cases, a pressure plate 45 is pressed against the dry ice.

A bias 46 such as an adjustable compression spring or pneumatic cylinder presses against plate 45 so as to push the ice against a movable carrier (often called a "production wheel" herein) 50. Movable carrier 50 is mounted to the frame for rotation around horizontal axis 51. It is driven by an adjustable speed, bi-directional motor 52. Movable carrier 50 has an upstream face 53 and a downstream face 54. These faces are parallel to one another. The upstream face is borne against by the dry ice. The downstream face faces into chute 42*a*.

Chute 42*a* will direct freshly-passed dry ice to fall against upper surface 28 of airlock rotor 21. When a transfer chamber 32 in the airlock is beneath the chute, it receives a supply of particles or pellets from the chute.

As the airlock rotates it presents a sequence of transfer chambers 32 to the outlet chute 33. Each chamber receives an amount of particles proportional only to the speed of the rat determining element (moveable carrier 50). The displaced volumetric rate of the chambers 32 is greater than the product in capacity of the moveable carrier assembly 50 and its associated parts at maximum speed. The chute 42*a* is partially closed while the next chamber arrives. The partially full chamber ultimately reaches outlet port 18, at which time air pressure from air hose 25 will blow the particles out, thereby combining the air and the particles to constitute a blasting airstream.

The object of this invention is to meter and/or produce dry ice particles of specific sizes and characteristics by the use of a single movable carrier 50. It is intuitively evident that metering preformed pellets, extracting granules, or extracting a mixture of particle sizes on demand from any form of preformed solid dry ice involves different considerations.

Figure 5:
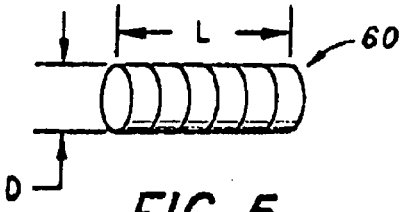
FIG. 5 shows a dry ice pellet used in this invention.

Pellets 60 are sold by suppliers or are generated in-plant from liquid carbon dioxide in a generally cylindrical shape such as shown in FIG. 5. Generally they are formed as a stack of flat lozenges, because of the way they are made from liquified carbon dioxide gas. A common size used in dry ice blasting is called "rice-size" and they have an approximate nominal length of about 0.08 to 0.60 inches and a nominal diameter of about 0.125 inches.

Figure 6:
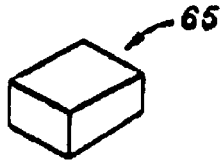
FIG. 6 schematically shows a fragment of dry ice produced by the production wheel in one of its modes.

The form of the granules 65 (FIG. 6) made from a block of dry ice (rather than from pellets) is schematically shown in FIG. 6. and is similar in shape and size to granulated white table sugar, shown here as a cubic structure. In any event, they are not similar to the pellets of FIG. 5. Their mean dimensions are preferably about 0.030 inches. It is evident that a different device is needed to generate the particles of FIG. 6 than to dispense the pellets of FIG. 5.

Dispensing of Pellets

Figure 3:
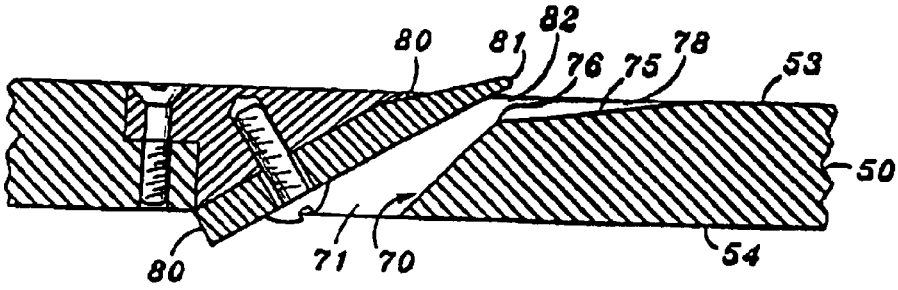
FIG. 3 is a fragmentary cross-section taken at line 3—3 in FIG. 2.

A first set of passages 70 to dispense pellets 60 is provided on the upstream face of movable carrier 50. There may be any suitable number of these passage, spaced angularly and/r radially apart from one another. They will all face in the same rotational direction and in alignment with the first rotational direction of the movable carrier 50. In FIG. 3, they face in the counter-clockwise direction (the "first" direction). Actually the choice of direction is optional. It is merely necessary that pellets be dispensed when the movable carrier 50 turns in one direction, and granules (or, as will be seen, a mixture) are produced when the movable carrier turns in the other direction. Also, that the device which is functional in one direction should not impede or excessively adversely affect the desired function of the other direction.

FIG. 3 shows a selected passage of the first set of passages 70, this for metering pre-formed pellets from a supply of pellets. Because these passages all are similar, only one will be described in detail. The upstream face 53 and downstream face 54 are shown with slot 71 between them.

Slot 71 exits freely to the chute 55. Because its object is to pass as large a proportion of pellets as possible, with minimal change in pellet integrity, the slot requires relief from the surface of the group of pellets, and a cut-off which will both divert and organize (to at least a limited extent) the particles so they can pass through the slot. In turn, the slot must be large enough to pass properly aligned pellets without fragmenting them, but small enough to reject them when the movable carrier 50 is not moving. The fate of the rejected pellets is left to a sequential slot of the same kind.

A relief ramp 75 is formed in upstream face 53, sloping gradually from face 73 to an edge 76, the leading edge of slot 71. It is a gradual ramp, which forms a recess dimension 78. This enables pellets which abut the upstream face to move axially and gradually toward the slot.

A diverter blade 80 faces toward the slot, and overhangs part of it as shown in FIG. 3. This diverter blade 80 may be configured to be adjustable and thus may be used to change the width of the passage if different pellet sizes are utilized. Its diverter edge 81 is substantially in the plan of upstream face 53, and in no case does 81 protrude from the face more than the cutting edge 92 in FIG. 4, described later. Viewed in the plan of FIG. 3, there is a width 82 between diverter edge 81 and leading edge 76, which will accommodate the expected diameter of pellet.

The axial offset between the recessed edge of the ramp and the edge of the diverter is a bit larger, and facilitates passage of the pellets along the angular path defined by the ramp.

What this arrangement accomplishes is the separation of pellets which bear against the upstream face from the body of pellets, with least disruption to the pellets. It should especially be a noticed that the diverter edge 81 is practically coplanar with upstream face 53, and that the ramp is "beneath" it.

Accordingly, this passage is effective only when the diverter edge is facing into the pellets, i.e., moving in the "first" direction. When reversed in the second direction of rotation, it has no effect because the solid block of dry ice (or other form of dry ice) will not contact it.

Production and Metering of Granules

A second set of passages 90 is provided to generate granules 65 when the movable carrier is moved in the substantially different "second" direction. In this example its effective direction is opposite from that of the first set of passages 70. When it extracts granules from preformed solid dry ice instead of from pellets, it attacks the ice with a working edge that rises above upstream face 53.

The passages 90 of the second set have blades 91 which extend radially to form a cutting edge 92 for a slot 93. Slot 93 extends through the movable carrier. Extracted granules passing through it are deposited in the chute.

Figure 4:
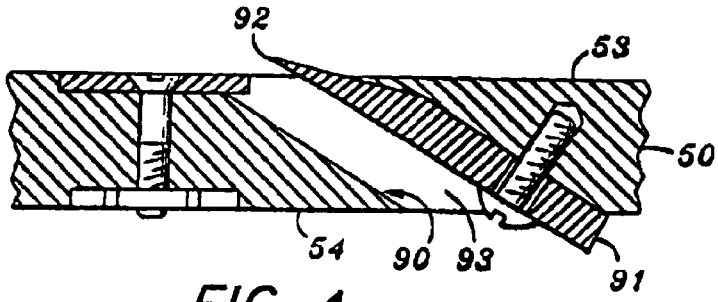
FIG. 4 is a fragmentary cross-section taken at line 4—4 in FIG. 2.

As seen in FIG. 4, cutting edge 92 rises above the plane of upstream face 73 of the movable carrier. The other edge 94 of the slot (which leads during the granulating operation), is preferably in the plane of the upstream face, and guides the granules into the slot.

When the movable carrier is moved in the second direction, cutting edge 92 bites into the solid dry ice. It will be recalled that the diverter edge 81 of the pellet slot in the first set of passages is in the plane of the upstream face. Thus it does not interfere with the solid dry ice, either by cutting it or by pushing against it.

It follows that when pellets are dispensed, the granulating system does not interfere, and when granules are extracted, the pellet system does not interfere. To switch from one operation to the other, it is only necessary to switch the direction of movement of the movable carrier, and possibly to change the raw material from pellets to block, or vice versa.

It is a convenience to form the cutting edges on a separate blade attached to the movable carrier by fasteners, as shown. This enables easy maintenance and replacement by the edges.

Production and Dispensing of Mixed Sizes

The ability to operate in the granulation mode of operation with a supply of preformed pellets presents another available benefit of this invention. While it is possible to completely and uniformly granulate pellets, the applicant has found that by varying the opening of slots 93 the, apparatus can produce a particle stream of different characteristics than either primarily pellets or primarily granules. It is well known in abrasive grit blasting that the use of a mixture of particle sizes can deliver improved performance in some applications. By adjusting the opening of the slot 93 with an adjustable plate 91 it is possible to generate from pellets a range of particle sizes from complete and thorough granulation up to a partial dicing of the pellets and varying combinations thereof. As used in this specification, the term "modification" does not include adjustment of plate 91 to work on pellets. The same production wheel is used for all three modes of production without modification. Adjustment, when needed, is of plate 91, and is not a modification requiring reconstruction or substitution of the production wheel.

Figure 7:
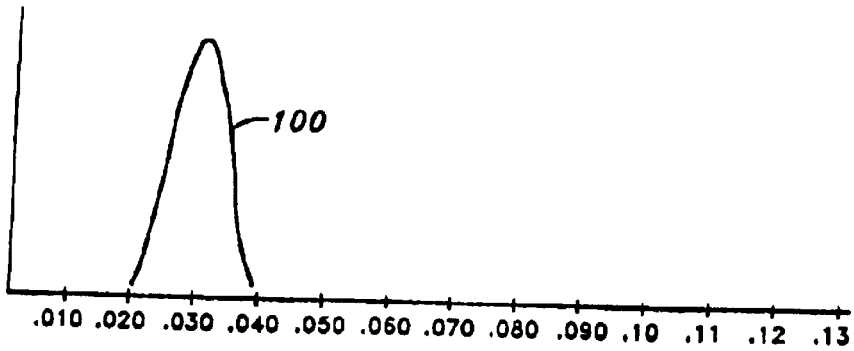
FIG. 7 is a schematic graph showing a mass distribution of particles generated in one mode.
Figure 8:
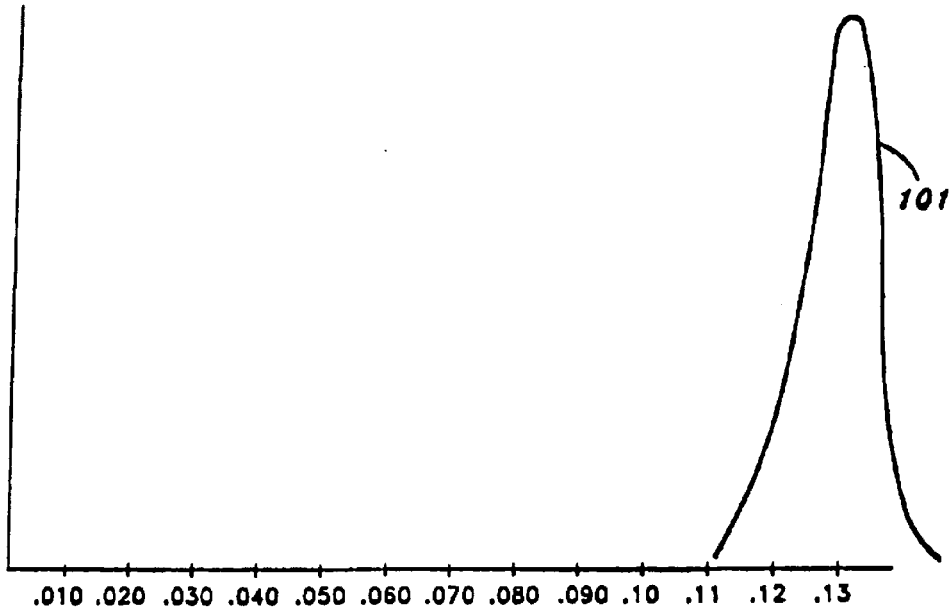
FIG. 8 is a similar graph showing a particle size distribution.
Figure 9:
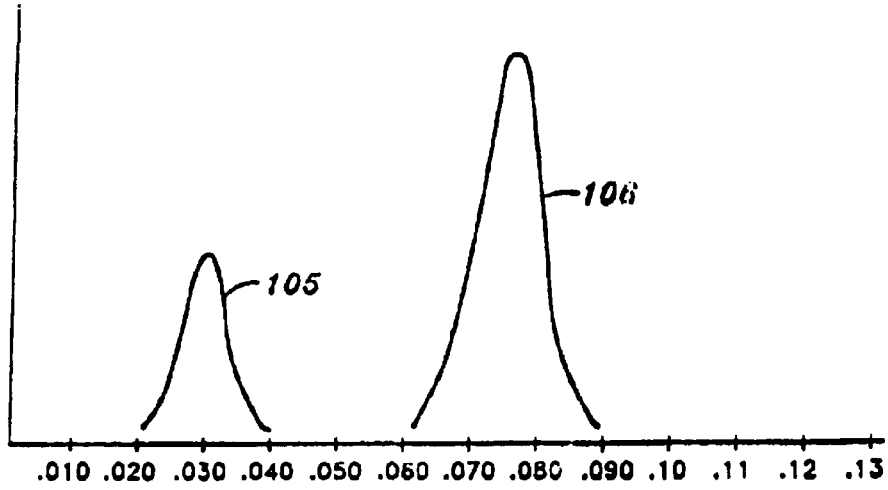
FIG. 9 is a similar graph showing a mixture of mass sizes.

An example of size distribution granules (the granules 65 of FIG. 6) extracted from a block of dry ice (rather than from pellets) is schematically shown by graph 100 in FIG. 7 and this graph 101 can be compared to the distribution of pellets only (the pellets 60 of FIG. 5), FIG. 8 and a partial granulation of pellets in the graph of FIG. 9, resulting in mixed mass sizes 105, 106. Importantly, it will be observed that in all cases there will be some variation of masses among the generated product. The curves show their distribution.

This alternative of providing a mixture of larger and smaller particles presents major advantages. The effects of the blasting stream depend on the momentum of the particles. The smallest particles will abrade a surface, but often not effectively. Still they can dislodge and flush away smaller residues while the larger particles strongly impact a surface. The capacity to vary the proportion of more and less massive particles is a considerable advantage. For this, pre-formed pellets are provided instead of a solid block, and can thereby provide particles of various mass distribution.

This invention is not to be limited by the embodiment shown in the drawings and described in the description, which is given by way of example and not of limitation, but only in accordance with the scope of the appended claims.

What is claimed is:

1. Apparatus for dry ice blast cleaning that is capable of both metering and blasting preformed dry ice pellets, and also capable of producing and blasting smaller dry ice granules, with said apparatus comprising:

a base;

a carrier movably supported relative to the base;

a driver for powering the carrier in either of two substantially different directions;

a means for controlling the movement direction of the carrier;

a means for controlling the movement rate of the carrier;

a first set of passages located on the carrier with a geometry that meters pellets when the carrier is moved in a first direction;

a second set of passages located on the carrier that incorporate a working edge that defines a cutting surface during the movement of the carrier in a second and substantially different direction;

a feeder for receiving and delivering a supply of dry ice and advancing same in a feed path in contact with the carrier passages as they move across the feed path;

a duct having an outlet, the dry ice particles being directed from the carrier passage slot flow from the outlet, there being substantially no storage of particles in the duct; and an accelerator for accelerating the dry ice particles, the accelerator being connected to the outlet.

2. Apparatus according to claim 1 wherein the carrier is a wheel rotatably supported on a carrier axis.

3. In a system for providing a blasting stream of air and dry ice particles entrained in said air, a particle generator adapted selectively to produce shaved granules of dry ice from block dry ice, or pellets from a supply of pelletized dry ice, without modification of said generator, said generator comprising:

a receptacle to receive dry ice in pellet or block form, said receptacle having an end wall with an opening, and a chute receiving product from said opening;

a production wheel having an axis of rotation, an upstream face and a downstream face, said production wheel being mounted in said receptacle for selective rotation in either a first or a second direction, said downstream face facing said opening in said receptacle wall, and said upstream face facing into said receptacle for bearing contact by dry ice pellets or by dry ice block, said production wheel including a pellet metering slot extending between said upstream and downstream faces, a metering edge facing in said second direction and an entry edge facing in said first direction, said metering edge lying in the plane of said upstream face, and said entry edge being recessed into said upstream face by a ramp; and a shaving slot extending between said upstream face and said downstream face, a cutting edge facing in said second direction, raised above the plane of said upstream face, and an edge spaced from said cutting edge to admit shavings to said slot, whereby in one direction of rotation with pellets bearing against said upstream face, said metering edge drives particles into its respective slot, and in the other direction of rotation, said cutting edge shaves dry ice particles from a block of dry ice into its respective slot, no edge adversely affecting dry ice in said receptacle when the production wheel is rotated to produce particles generated by the other edge.

4. Apparatus according to claim 3 in which said cutting edge of said shaving slot is adjustably positionable above the plane of said upstream face, whereby, when pellets instead of block dry ice are encountered in said second direction, a mixture of particles of various ratios of more and less massive particles are generated, the ratio between them being determined by the position of said cutting edge.

5. The method of selection by metering pellets of dry ice and shaving of particles from block dry ice, utilizing a movable surface that can be reversed in direction, having a set of pellet metering slots facing in one direction, and a set of shaving slots facing in the opposite direction, said method comprising:

with pellets pressed against the movable surface in a direction so the pellet metering slots admit pellets to a user device; and with block ice pressed against the movable surface in the opposite direction so the shaving slots remove dry ice particles from the block and pass them to a user device.

6. A method according to claim 5 in which said pellets are pressed against the surface, and the surface is rotated in said opposite direction to generate particles of mixed mass size.

7. A method according to claim 5 in which said movable surface is on a rotatable production wheel.

* * * * *